US008418864B2

(12) United States Patent
Ravard et al.

(10) Patent No.: US 8,418,864 B2
(45) Date of Patent: Apr. 16, 2013

(54) BOTTLE HAVING A TEAT ATTACHED BY A RING WITH MOBILE ELEMENTS, CORRESPONDING RING AND TEAT

(75) Inventors: Frank Ravard, Nantes (FR); Joseph Mazoyer, Saint Foy les Lyon (FR); Frederic Strubi, Lyons (FR)

(73) Assignee: Cosco Management, Inc., Wilmington, DE (US)

( * ) Notice: Subject to any disclaimer, the term of this patent is extended or adjusted under 35 U.S.C. 154(b) by 1084 days.

(21) Appl. No.: 12/365,531

(22) Filed: Feb. 4, 2009

(65) Prior Publication Data

US 2009/0255894 A1 Oct. 15, 2009

(30) Foreign Application Priority Data

Apr. 15, 2008 (FR) ..... 08 52536

(51) Int. Cl.
*B65D 21/02* (2006.01)

(52) U.S. Cl.
USPC ..... 215/11.1; 215/229; 215/382; 215/386; 215/396; 220/270; 220/276; 220/707; 220/709; 220/760

(58) Field of Classification Search ..... 215/11.1, 215/229, 382, 396; 220/254.2, 256.1, 270, 220/276, 288, 707, 708, 709, 695; 222/207, 222/472, 567, 570, 109, 143; 294/31.2, 33
See application file for complete search history.

(56) References Cited

U.S. PATENT DOCUMENTS

| | | | | |
|---|---|---|---|---|
| 2,588,991 A * | 3/1952 | Schellin | ..... | 215/11.1 |
| 2,753,067 A * | 7/1956 | Rodriguez | ..... | 215/11.1 |
| 5,150,801 A | 9/1992 | Held | | |

FOREIGN PATENT DOCUMENTS

| | | |
|---|---|---|
| DE | 296 21 392 | 3/1997 |
| DE | 197 39 911 | 6/1998 |
| FR | 2887764 | 1/2007 |
| FR | 2 929 844 | 10/2009 |

OTHER PUBLICATIONS

Search Report dated Apr. 15, 2008, for French Application FR0852536.

* cited by examiner

*Primary Examiner* — Anthony Stashick
*Assistant Examiner* — Cynthia Collado
(74) *Attorney, Agent, or Firm* — Barnes & Thornburg LLP

(57) ABSTRACT

A feeding bottle includes a flask, a teat and a connecting ring intended to fix the teat to the flask, at an opening in the latter, defined by a neck, and a connecting ring configured such that there is at least one locking position in which the connecting ring is fixed to the flask and an unlocking position in which the ring to be removed from the flask.

22 Claims, 4 Drawing Sheets

BOTTLE HAVING A TEAT ATTACHED BY A RING WITH MOBILE ELEMENTS, CORRESPONDING RING AND TEAT

This application claims the benefit of priority to France Patent Application No. 0852536 filed Apr. 15, 2008, which is incorporated herein by reference in its entirety.

FIELD

The field of the disclosed embodiments is that of child care. More precisely, the embodiments concern feeding bottles and in particular the fixing of the teat to the flask of the feeding bottle.

BACKGROUND

Conventionally, feeding bottles are composed of a flask whose opening, which is defined by a neck, can receive a teat. The teat, which can be composed for example of rubber or silicone, comprises in particular a base forming an annulus, bearing on the neck of the feeding bottle.

This teat is generally fixed to the flask by means of a connecting ring that is screwed onto the neck of the flask and, once screwed, tightens the annulus-shaped base of the teat against the edge of the neck of the flask.

This screwing effected by the user requires several movements, and tricky adjustment. This is because the level of tightening of the connecting ring on the flask must be adjusted carefully to allow correct use of the feeding bottle.

This tightening must be sufficient to guarantee the retention of the teat. This retention, which is checked by a standard test, aims to prevent traction exerted on the teat making it possible to remove it. This removal, effected by the child, would obviously give rise to a risk of spillage of the content of the feeding bottle.

The tightening must however not be too great. This is because excessive tightening may in some cases damage these objects by causing shrinkage of the base of the excessively compressed teat, which then passes into the neck of the flask and no longer ensures either the holding of the teat or its sealing. This excessive tightening also gives rise to a risk of damage to the teat.

Moreover, tightening of the teat must also make it possible to allow or not a passage of air between the teat and the flask of the feeding bottle. This is because air must enter the flask as the liquid contained is consumed.

Some feeding bottles are designed so that the air enters the flask between the base of the teat and the neck of the flask. In this case, excessive tightening prevents this entry of air, which is opposed to the correct use of the feeding bottle. On the other hand, insufficient tightening causes excessive entry of air and therefore an excessively high output of the feeding bottle, and a risk of leakage of liquid.

On feeding bottles of more recent design, comprising an independent valve allowing the entry of air into the feeding bottle, the tightening must ensure sealing of the feeding bottle.

In addition, the level of tightening necessary for different teats on the same feeding bottle does not necessarily correspond to the same number of turns for screwing the ring onto the feeding bottle. This is because the tightening must be adapted according to the thickness of the base of the teat, which may vary slightly due to teat manufacturing tolerances and the characteristics of the material used for the teat (rubber, silicone, or any other material).

This question of tightening of the neck of the feeding bottle therefore often poses a problem for the users, and therefore for the designers of the feeding bottles, who are led to develop systems that are complex, expensive and in the end often difficult to use.

SUMMARY

Disclosed embodiments overcome these drawbacks of the prior art. More precisely, disclosed embodiments simplify the assembly of the feeding bottles, and in particular the fixing of the teat to the flask.

Additionally, disclosed embodiments provide a feeding bottle for which the assembly of the teat and flask of the feeding bottle requires fewer movements by the user and is more rapid.

Moreover, disclosed embodiments offer to the user a connecting solution making it possible to obtain, without difficulty and without hesitation, the correct level of tightening of the connecting ring on the flask, and thus to avoid excessive or insufficient tightening.

Furthermore, disclosed embodiments enable the user of the feeding bottle to obtain a constant level of tightening of the connecting ring, independent of the uncertainties of thickness of the base of the teat.

Finally, disclosed embodiments provide a feeding bottle that is at the same time reliable, effective and pleasant to use, but also easy and inexpensive to manufacture.

These features, as well as others that will appear subsequently, are achieved by means of a feeding bottle comprising a flask, a teat and a connecting ring intended to fix the teat to the flask, at an opening in the latter, defined by a neck, in which the neck has at least one lug, and the connecting ring is equipped with at least one locking element able to cooperate with one of the lugs, each of the locking elements being able to move with respect to the connecting ring, so as to be able to adopt, when, the connecting ring is in position on the flask, at least two positions: a locking position in which it cooperates with the corresponding lug of the flask so as to connect the connecting ring to the flask; and an unlocking position in which it allows removal of the connecting ring from the flask.

Thus, the novel approach is based on a connecting ring that is not, as in the prior art, locked by its own rotation movement with respect to the flask but by a movement of locking elements themselves able to move with respect to the ring. Thus, once the ring is fitted on the flask by a vertical movement, it is no longer necessary to move it. This novel method of locking the connecting ring allows easier and more effective mounting of the teat on the flask.

According to a disclosed embodiment, each of the locking elements is able to move in rotation on a horizontal axis.

Such a rotation movement allows reliable and effective functioning of the locking elements.

Each of the locking elements may be able to move between the locking position, in which a hook portion of the locking element is in contact with the bottom surface of the corresponding lug, and the unlocking position, in which the hook portion of the locking element is not in contact with the bottom surface of the corresponding lug.

According to a disclosed embodiment, the hook portion has a general U shape and the locking elements are able to move in rotation between the locking position in which the opening of the U is not oriented in the direction opposite to the opening of the flask and the unlocking position in which the opening of the U is oriented in the opposite direction to the opening of the flask.

This configuration of the locking elements makes it possible to ensure very reliable locking with a slight movement of the locking elements. It therefore simplifies the locking of the ring on the flask.

Further, the hook portion is equipped with a ramp forming a protrusion and able to exert a pressure on the bottom surface of the lug.

The locking action thus also ensures tightening of the ring on the flask.

Additionally, the lug comprises a tongue portion on the bottom surface, able to cooperate, in the locking position, with the ramp, to lock the movements of the locking element with respect to the lug along the principal axis of the feeding bottle.

The cooperation of the ramp of the hook and the tongue portion of the lug therefore allows more reliable locking of the ring on the flask. In particular, it makes it possible to prevent the locking elements being removed from the ring while the latter is locked on the flask.

According to a disclosed embodiment, the neck has two lugs, disposed diametrically on the neck, and the ring is equipped with a lever connected to the two locking pieces corresponding to the lugs and making it possible to actuate the locking elements in rotation about a common axis.

This embodiment allows effective locking and very great simplicity in use. To lock or unlock the connecting ring, the user has in fact only to act on a single lever.

In the locking position, the lever may at least partly match an external contour of the ring.

The lever is thus harmoniously integrated in the ring, in the position of use of the feeding bottle, and the user can see without any possible ambiguity that the lever is in the locked position.

According to a particular embodiment, the teat has a base conformed so as to have, when it is assembled between the ring and the neck, a different shape from its native shape (i.e., the shape it possesses when it is not acted on by other components).

The teat can thus fulfill a function of return means that afford a good seal, even without fine adjustment of the tightening of the ring against the flask.

The disclosed embodiments also concern a teat intended to be mounted on a flask, by means of a connecting ring, to form a feeding bottle, the teat having a base comprising a bottom surface, intended to be pressed in contact with the neck surrounding the opening of the flask. The teat also has a top surface, intended to be in contact with the bottom surface of the connecting ring, in which the top surface has, prior to compression between the neck and the ring, a surface not parallel to the bottom surface of the connecting ring so as to be elastically deformed when it is compressed between the neck and the ring.

This teat can be used effectively in the feeding bottle. It should, however, be noted that it can also be used on other types of feeding bottles.

In a disclosed embodiment, the top surface of the teat has a native shape that is frustoconical. This shape, in a particularly easy fashion, confers elasticity on the base that is to be pressed against a flat surface.

BRIEF DESCRIPTION OF THE FIGURES

Other features of the disclosed embodiments will emerge more clearly from a reading of the following description, given by way of simple illustrative and non-limitative example, and the accompanying drawings.

DETAILED DESCRIPTION

A feeding bottle generally consists of a flask on which a teat is fixed by means of a connecting ring. The principle of the disclosed embodiments is to provide on the connecting ring movable elements enabling it to be fixed to the neck of the flask. This is therefore no longer the movement of screwing of the connecting ring with respect to the flask that allows fixing, but the movement of these movable elements, once the connecting ring is in place on the flask.

In the following description of a feeding bottle according to one embodiment, the feeding bottle is considered to be in the position shown in FIG. 5. In this figure, the feeding bottle extends along a vertical axis, the opening in the flask and the teat being directed upwards. Thus the "top" of the flask is defined by its opening, on which the teat is to be mounted, and the bottom of the flask is its portion opposite to its opening.

Likewise, the expression "bottom surface of the lug" designates the surface of the lug directed downwards, that is to say in a direction substantially opposite to the direction of the opening of the flask. In the same way, the axes perpendicular to the principle axis along which the feeding bottle extends are designated by the term "horizontal axis".

Figure 1:
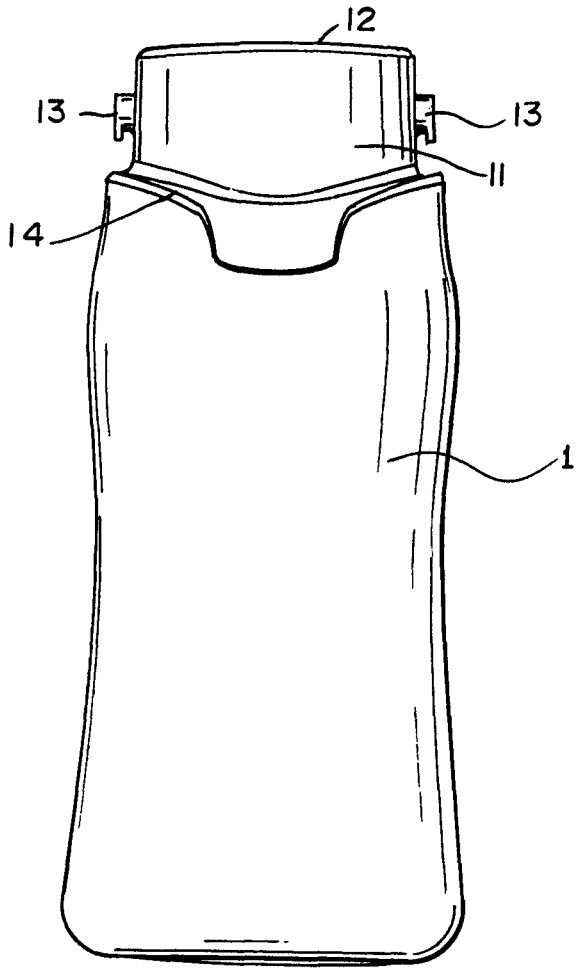
FIG. 1 is a view of the flask of a feeding bottle according to one embodiment.
Figure 2:
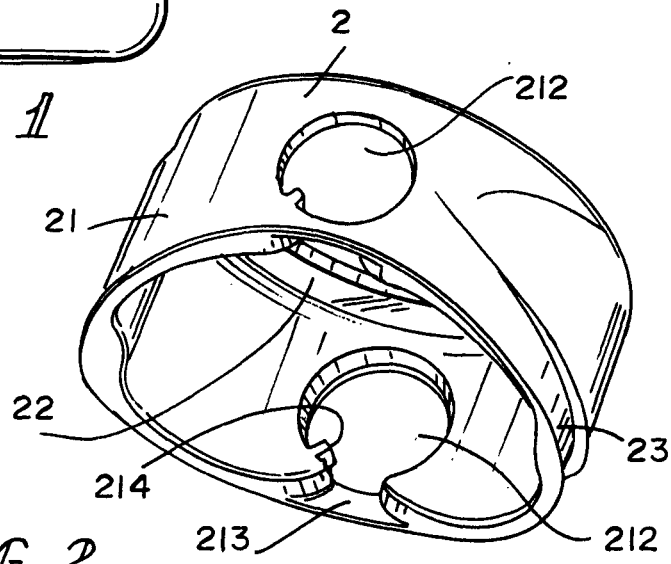
FIG. 2 is a view in perspective of the connecting ring intended to fix a teat to the flask in FIG. 1.

FIGS. 1 and 2 show respectively the flask 1 and the connecting ring 2 of a feeding bottle according to one embodiment As shown by FIG. 1, the flask 1 comprises a cylindrically shaped neck 11 that defines the opening 12 of the flask 1. This neck 11 comprises, on its external face, two pins or lugs 13 distributed diametrically. These lugs 13, which can be moulded with the flask of the feeding bottle, may, according to one embodiment, be oblong or substantially cylindrical in shape, extending along a substantially horizontal axis.

The connecting ring 2, or fixing ring, is intended to be placed on the neck 11 of the flask 1 and to be fixed to the latter to hold a teat against the opening 12 of the flask 1. For this purpose the connecting ring 2 has a horizontal part 22 forming a circular annulus (visible in FIGS. 2 and 4) intended to press the base of the teat against the edge of the neck 11 of the flask 1.

Figure 5:
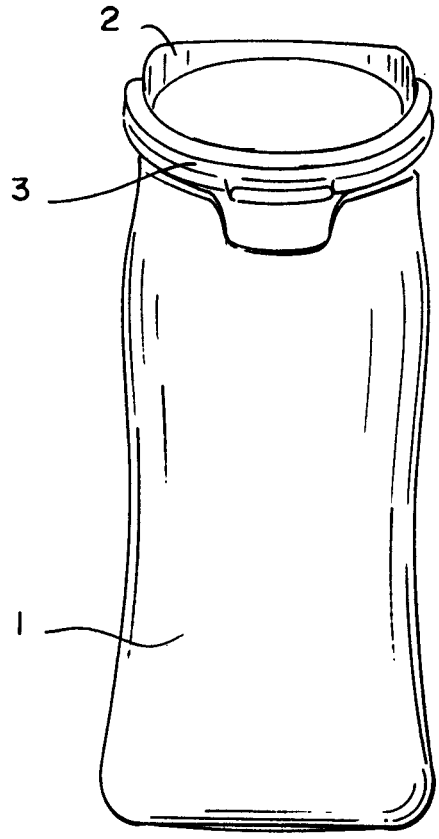
FIG. 5 is a view of the flask of FIG. 1 equipped with the connecting ring of FIG. 4 in the locked position.

The connecting ring 2 also comprises a vertical part 21 forming a cylinder and configured to surround the neck 11 and to be fixed thereto, as shown in FIG. 5. The internal surface of this vertical part 21 is configured to come against the external surface of the neck 11 of the flask 1.

The vertical part 21 of the connecting ring 2 has openings 212 substantially circular in shape, the position of which corresponds, when the connecting ring 2 is in place on the flask 1, to the position of the lugs 13 of the neck 11 of the flask. Each of these openings 212 can receive a locking element capable of cooperating with the corresponding lug 13.

The internal surface of the vertical part 21 of the connecting ring 2 also has notches 213 situated between the bottom edge of the connecting ring 2 and each of the openings 212 and making it possible, when the connecting ring 2 is placed on the neck of the flask 1, to make the lugs 13 of the neck 11 pass into the openings 212.

Figure 3:
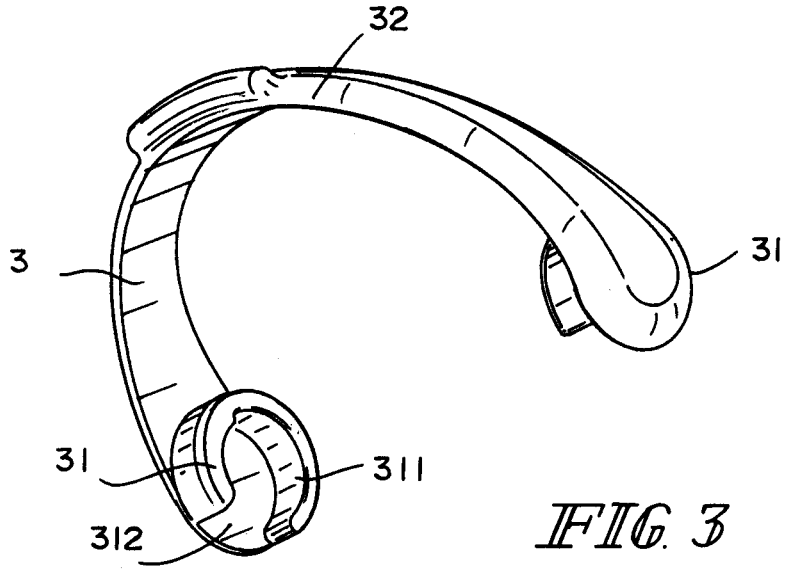
FIG. 3 depicts the locking piece intended to equip the connecting ring of FIG. 2.
Figure 4:
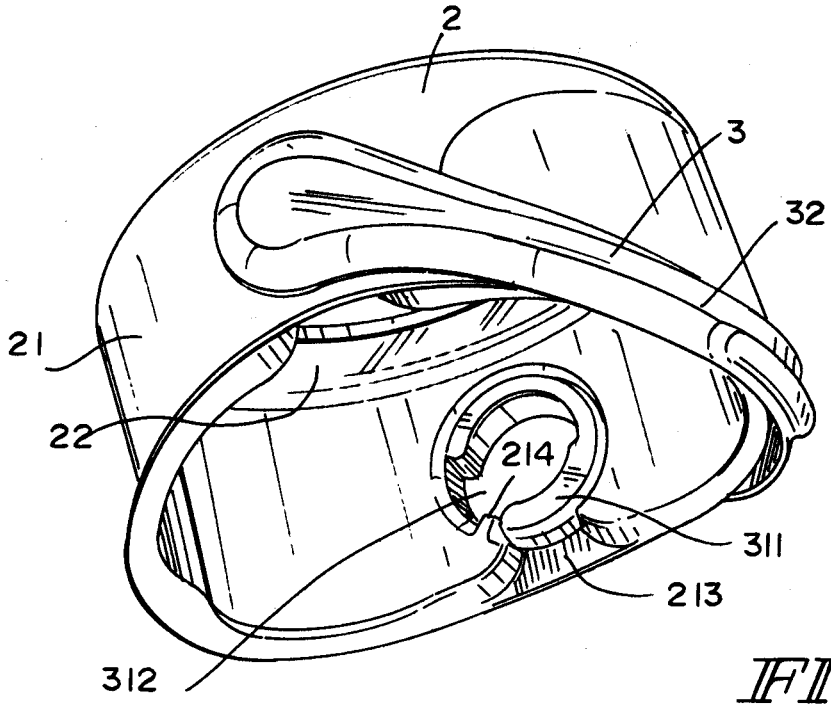
FIG. 4 depicts the connecting ring of FIG. 2 equipped with the locking piece of FIG. 3.

To be able to be fixed to the neck 11 of the flask 1, the ring 2 is equipped with a locking piece 3, which is shown in FIG. 3. FIG. 4 shows this ring 2 equipped with the locking piece 3. This locking piece 3 carries two locking elements 31, which are each intended to enter one of the openings 212 in the ring 2, and which are connected to each other by a connecting portion 32. The substantially circular shape of the openings 212 allows the rotation, in these openings, of each of the locking elements 31.

The two locking elements 31 carried by the locking piece 3 can pivot on the same rotation axis, so that the piece 3 can pivot fully around this axis. The connecting portion 32 of the piece 3 advantageously forms a lever so as to easily actuate this rotation.

When the locking piece 3 is mounted on the ring, as shown in FIG. 4, the locking elements 31 have, on their face appearing inside the ring 2, hook portions 311 configured to cooperate with the corresponding lug 13 on the neck 11 of the flask 1. These hook portions 311 have a roughly U shape, or C shape, able to surround the lug 13. They define an opening 312, corresponding to the U- or C-shaped opening, allowing passage of the lug 13 in the hook portion 311.

The locking elements 31 can adopt a position, referred to as the unlocking position, in which the opening 312 of the hook portions 311 is turned downwards, and coincides with the notches 213 in the connecting ring 2. In this position, the ring 2 can be placed on the neck 11 of the flask 1. The lugs 13 of the neck 11 then pass into the notches 213 in the ring and then engage in the hook portions 311 through the openings 312. When the ring 2 is in place on the flask 1, each of the hook portions 311 therefore surrounds the lug 13 corresponding to it, except on the bottom surface of this lug 13. The ring 2 is then not locked on the neck 11 of the flask 1 and can be removed from it.

If, when the ring 2 is in place on the flask, the locking elements 31 are made to pivot, by acting on the connecting portion 32 to make the locking piece 3 pivot, the opening 312 in each of the hook portions is offset and is therefore no longer oriented downwards. It then no longer coincides with the notches 213 in the connecting ring. The lug 13 that is engaged in this hook portion 311 can then no longer emerge from it.

Figure 6:
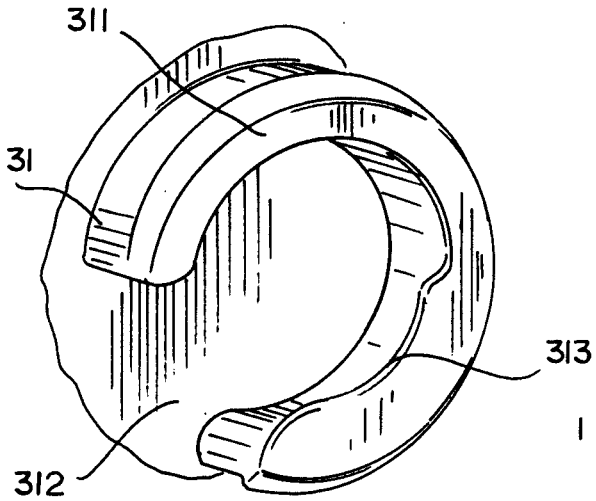
FIG. 6 is a detail view of a locking element of the locking piece of FIG. 3.
Figure 7:
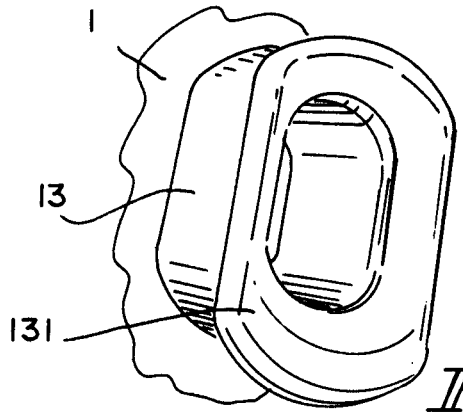
FIG. 7 is a detail view of a lug of the flask of FIG. 1.

According to a disclosed embodiment, shown in more detail in FIGS. 6 and 7, the surface of the lug 13 furthest away from the neck 11 of the flask is extended by a first tongue portion 131, extending downwards. Likewise, the hook portion 311 of each locking element comprises a second tongue portion or ramp 313 on its part that is to be in contact with the bottom surface of the lug 13, in the locking position.

Thus, in the locking position, the two tongue portions cooperate with each other so as to prevent the locking element 31 being removed from the corresponding lug 13 in a direction perpendicular to the principle axis of the feeding bottle. The tongue portions, in particular, prevent the locking piece 3 being removed from the ring 2 in the locking position.

In addition, this ramp 313 forms a protrusion with respect to the lug 13. Consequently, in the locking position, it exerts a pressure on the bottom surface of the lug, which causes a pressure of the connecting ring against the neck of the feeding bottle and holds the various elements together without possible movement along the principal axis of the feeding bottle.

According to a disclosed embodiment, the opening 212 in the ring 2 is equipped with a stop 214, which limits the possible rotation of the locking piece 3 to a defined angular range. One of the extreme positions of the locking piece 3 in this angular range, which is shown in FIGS. 4 and 5, corresponds to the locking position, and the other extreme position to the unlocking position.

The locking of the ring 2 on the neck 11 of the flask 1 is provided by the locking piece 3 passing over a tight spot. According to a disclosed embodiment, this tight spot is provided easily by a lightly protruding relief 24 on the connecting ring 2. Thus, it is necessary to slightly force the locking piece 3 into its locking position or to make it leave this position. This tight spot enables the user to easily feel when this piece is in the locking position and to prevent unwanted unlocking of the ring.

In addition, the ring 2 and the flask 1 shown in FIGS. 1 and 2 can have a relief 23, 14 adapted to match the shape of the connecting portion 32 of the locking piece 3, while ensuring the locking by passing the tight spot 24. Thus, the user can easily feel and also see whether this locking piece 3 is correctly locked.

To have optimum sealing despite the uncertainties of thickness of the base of the teat, it is possible to use a teat whose base has high elasticity.

This is because the teat generally consists of elastic material such as rubber or silicone. When its base is compressed between the connecting ring and the opening in the flask of the feeding bottle, it acts as a spring tending to push the connecting ring of the flask.

The flexibility of the ring on conventional teats, the base of which forms a horizontal annulus, is however relatively low. Moreover, as indicated above, the thickness and mechanical properties of this base may vary between different teats.

To improve the flexibility of this base, and consequently to facilitate the hermetic closure of the feeding bottle, provision is made according to a particular embodiment to give the top face of the base of the teat a shape non-parallel to the bottom surface of the horizontal part of the connecting ring, against which it is to be pressed. The base of the teat will thus be subjected to a deformation movement, before possibly being subjected to a compression.

It can thus have elasticity over a greater amplitude than conventional teats and will then have lower stiffness. In addition, this stiffness will be less variable from one teat to another.

Figure 8:
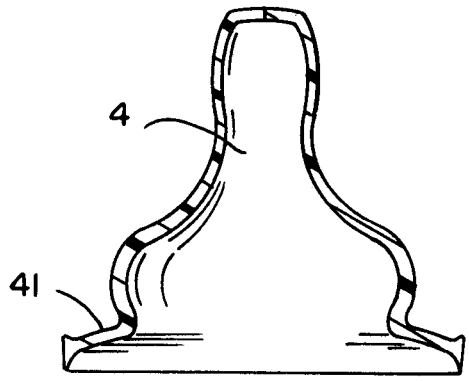
FIG. 8 is a view in partial cross section of a teat that can be used on a feeding bottle according to one embodiment.
Figure 9:
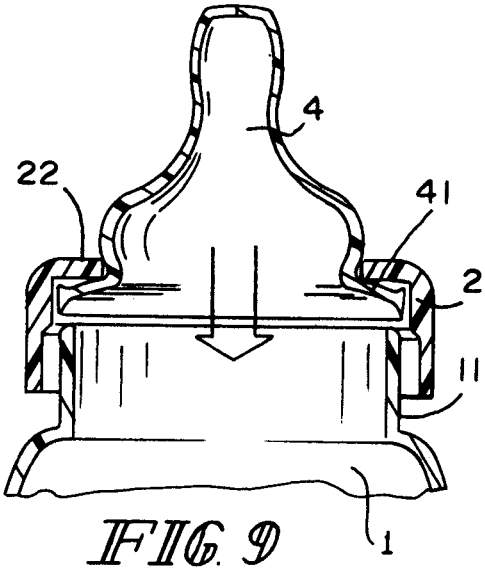
FIGS. 9 and 10 are views in partial cross section of the elements making up a feeding bottle, comprising the teat of FIG. 8, shown respectively, in the phase of placing the connecting ring on the neck of the flask, and when the ring is provided for locked fixing on the neck of the flask.
Figure 10:
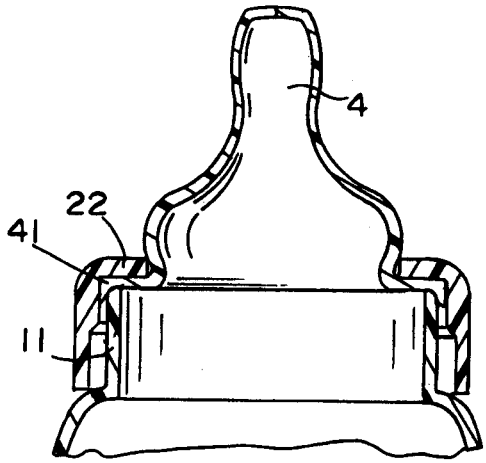

FIGS. 8 to 10 present an embodiment of such a teat. It should be noted that FIGS. 8 to 10 aim solely to depict the behaviour of such a teat when it is mounted on a feeding bottle rather than the fixing of the ring of the teat to the flask of the feeding bottle. These figures do not therefore make it possible to see the fixing elements. In these embodiments, the top and bottom faces of the base 41 of the teat have the shape of a truncated cone, or a frustoconical shape, and therefore form an angle with the horizontal.

Thus, when the teat is not connected to the feeding bottle, as shown in FIGS. 8 and 9, the return means constituted by the base 41 of the teat is not compressed. This ring then has a frustoconical shape and its top surface is thus not parallel to the bottom surface of the horizontal part 22 of the connecting ring 2.

On the other hand, when the base 41 of the teat 4 is compressed between the bottom surface of the horizontal part 22 of the connecting ring 2 and the top edge of the neck 11, its top surface deforms elastically to match the shape of the bottom surface of the horizontal part 22.

It should be noted that such a teat whose base is conformed so as to have great elasticity may also be used with other types of fixing between the flask of the feeding bottle and connecting ring of the teat.

The invention claimed is:

1. A feeding bottle comprising:

a flask having an opening defined by a neck, and the flask having a vertically-oriented longitudinal axis running along a length of the flask and being perpendicular to a horizontally-oriented axis running substantially parallel to a surface of the opening;

a teat;

a connecting ring configured to fix the teat to the flask at the opening of the flask;

at least one locking element separate from the connecting ring;

wherein the neck comprises at least one lug;

wherein the connecting ring is configured to be connected to the at least one locking element, the at least one locking element being configured to engage with the at least one lug;

wherein the at least one locking element is configured to move with respect to the connecting ring and is configured to adopt, when the connecting ring is in position on the flask, at least two positions:

a locking position in which the connecting ring engages with the at least one lug of the flask so as to fix the connecting ring onto the flask; and an unlocking position in which the connecting ring is configured to be removable from the flask.

2. The feeding bottle of claim 1, wherein the at least one locking elements includes a hook portion and wherein the at least one locking element is configured to move between:

the locking position, in which the hook portion of the at least one locking element is in contact with a bottom surface of the at least one lug, and the unlocking position, in which the hook portion of the at least one locking element is not in contact with the bottom surface of the at least one lug.

3. The feeding bottle of claim 2, wherein the hook portion has a generally U shape defining an opening and wherein the at least one locking element is configured to move rotationally between:

the locking position in which the opening of the generally U shape is not oriented in a direction opposite to the opening in the flask; and the unlocking position in which the opening of the generally U shape is oriented in the direction opposite to the opening in the flask.

4. The feeding bottle of claim 2, wherein the hook portion is equipped with a ramp forming a protrusion and is configured to exert a pressure onto a bottom surface of the at least one lug.

5. The feeding bottle of claim 4, wherein the at least one lug includes a tongue portion on the bottom surface, which tongue is configured to cooperate, in the locking position, with the ramp to lock movement of the at least one locking element, with respect to the at least one lug, about the horizontally-oriented axis.

6. The feeding bottle of claim 1, wherein the neck includes two lugs disposed diametrically on the neck, and the at least one locking element includes two locking elements, and wherein a lever is connected to the two locking elements, the lever being configured to actuate the locking elements rotationally about the horizontally-oriented axis.

7. The feeding bottle of claim 6, wherein, in the locking position, the lever at least partly matches an external contour of the connecting ring.

8. The feeding bottle of claim 1, wherein the teat has a base configured to take a first shape when the teat is in place between the connecting ring and the neck, and the first shape is a different shape from a second shape of the base when the teat is separated from the connecting ring and flask.

9. A feeding bottle comprising:

means for holding a liquid, the means for holding the liquid including an opening defined by a neck;

means for controlling flow of the liquid out of the opening;

means for coupling the means for holding the liquid to the means for controlling the flow of the liquid at the opening;

wherein the neck includes at least one lug;

at least one locking means separate from the means for coupling;

wherein the means for coupling is configured to be connected to the at least one locking means, which at least one locking means is configured to engage with the at least one lug; and the at least one locking means is configured to move with respect to the means for coupling to adopt at least two positions including a locked position in which the at least one locking means engages with the at least one lug to fix the means for coupling to the means for holding liquid, and, an unlocked position in which the at least one locking means is configured to enable removal of the means for coupling from the means for holding liquid.

10. A feeding bottle of claim 9, wherein the at least one locking means is configured to move rotationally about a horizontally-oriented axis running substantially parallel to a surface of the opening.

11. A feeding bottle of claim 9, wherein the at least one locking means includes a hook portion and wherein the at least one locking means is configured to move between the locked position, in which the hook portion of the at least one locking means is in contact with a bottom surface of the at least one lug, and the unlocked position, in which the hook portion of the at least one locking means is not in contact with the bottom surface of the at least one lug.

12. The feeding bottle of claim 11, wherein the hook portion defines an opening and, wherein, the at least one locking means is configured to move rotationally between:

the locked position in which the opening is not oriented in a direction opposite to the opening in the means for holding the liquid; and the unlocked position in which the opening is oriented in the direction opposite to the opening in the means for holding the liquid.

13. The feeding bottle of claim 11, wherein the hook portion includes a ramp forming a protrusion configured to exert pressure onto the bottom surface of the lug.

14. The feeding bottle of claim 13, wherein the at least one lug includes a tongue portion on the bottom surface, which tongue portion is configured to cooperate, in the locking position, with the ramp to lock movement of the at least one locking means, with respect to the at least one lug, about a horizontally-oriented axis running substantially parallel to a surface of the opening.

15. The feeding bottle of claim 9, wherein the neck includes two lugs disposed diametrically on the neck, and the at least one locking element includes two locking elements, and wherein a lever is connected to the two locking elements, the lever being configured to actuate the locking elements in rotation about a horizontally- oriented axis running substantially parallel to a surface of the opening.

16. The feeding bottle of claim 14, wherein, in the locked position, the lever at least partly matches an external contour of the connecting ring.

17. The feeding bottle of claim 9, wherein the means for controlling the flow of the liquid has a base configured to have a first shape that is different from a second shape of the neck when the means for controlling the flow of the liquid is removed from the means for coupling and the means for holding the liquid.

18. A feeding bottle comprising:

a flask having an opening defined by a neck;

a teat;

a connecting ring intended to fix the teat to the flask, at the opening of the flask;

wherein the neck comprises at least one lug;

wherein the connecting ring is equipped with at least one locking element able to cooperate with one of the lugs;

each of the locking elements being able to move with respect to the connecting ring so as to be able to adopt, when the connecting ring is in position on the flask, at least two positions:

a locking position in which it cooperates with a corresponding lug of the flask so as to fix the connecting ring onto the flask;

an unlocking position in which it enables the connecting ring to be removed from the flask;

wherein each of the locking elements comprises a hook portion and wherein each of the locking elements is able to move between:

the locking position, in which the hook portion of the locking element is in contact with a bottom surface of the corresponding lug;

the unlocking position, in which the hook portion of the locking element is not in contact with the bottom surface of the corresponding lug;

wherein the hook portion has a general U shape defining an opening and wherein the locking elements are able to move in rotation between:

the locking position in which the opening of the generally U shape is not oriented in the direction opposite to the opening in the flask; and the unlocking position in which the opening of the generally U shape is oriented in the direction opposite to the opening in the flask.

19. A feeding bottle comprising:

a flask having an opening defined by a neck;

a teat;

a connecting ring intended to fix the teat to the flask, at the opening of the flask;

wherein the neck comprises at least one lug;

wherein the connecting ring is equipped with at least one locking element able to cooperate with one of the lugs;

each of the locking elements being able to move with respect to the connecting ring so as to be able to adopt, when the connecting ring is in position on the flask, at least two positions:

a locking position in which it cooperates with a corresponding lug of the flask so as to fix the connecting ring onto the flask; and an unlocking position in which it enables the connecting ring to be removed from the flask;

wherein each of the locking elements comprises a hook portion and wherein each of the locking elements is able to move between:

the locking position, in which the hook portion of the locking element is in contact with a bottom surface of the corresponding lug;

the unlocking position, in which the hook portion of the locking element is not in contact with the bottom surface of the corresponding lug;

wherein the hook portion is equipped with a ramp forming a protrusion and able to exert a pressure onto the bottom surface of the lug; and wherein the lug comprises a tongue portion on the bottom surface able to cooperate, in the locking position, with the ramp to lock the movements of the locking element with respect to the lug on the principal axis of the feeding bottle.

20. A feeding bottle comprising:

a flask having an opening defined by a neck;

a teat;

a connecting ring intended to fix the teat to the flask, at the opening of the flask;

wherein the neck comprises at least one lug;

wherein the connecting ring is equipped with at least one locking element able to cooperate with one of the lugs;

each of the locking elements being able to move with respect to the connecting ring so as to be able to adopt, when the connecting ring is in position on the flask, at least two positions:

a locking position in which it cooperates with a corresponding lug of the flask so as to fix the connecting ring onto the flask;

an unlocking position in which it enables the connecting ring to be removed from the flask; and wherein the neck has two lugs disposed diametrically on the neck, and wherein the connecting ring is equipped with a lever connected to the two locking elements corresponding to the lugs and making it possible to actuate the locking elements in rotation about a common axis.

21. A feeding bottle comprising:

means for holding liquid and including an opening defined by a neck;

means for controlling flow of the liquid out of the opening;

means for coupling the means for holding liquid to the means for controlling liquid flow at the opening;

wherein the means for coupling is configured such that there is at least one locking position in which the means for coupling is fixed to the means for holding liquid and an unlocking position in which the means for coupling can be removed from the means for holding liquid;

wherein the neck includes at least one lug;

wherein the means for coupling includes at least one locking means configured to cooperate with one of the lugs;

each of the locking means being configured to move with respect to the means for coupling to adopt at least two positions including a locked position in which the locking means cooperates with a corresponding neck lug to fix the means for coupling to the means for holding liquid, and, an unlocked position in which the locking means is configured to enable removal of the means for coupling from the means for holding liquid;

wherein each of the locking means comprises a hook portion and wherein each of the locking means is configured to move between the locked position, in which the hook portion of the locking means is in contact with a bottom surface of the corresponding lug, and the unlocked position, in which the hook portion of the locking means is not in contact with the bottom surface of the corresponding lug;

wherein the hook portion defines an opening and, wherein, the locking means are configured to move in rotation between:

the locked position in which the opening is not oriented in the direction opposite to the opening in the means for holding liquid;

the unlocked position in which the opening is oriented in the direction opposite to the opening in the means for holding liquid; and wherein the hook portion includes a ramp forming a protrusion configured to exert pressure onto the bottom surface of the lug.

22. A feeding bottle comprising:

a flask having an opening defined by a neck;

a teat;

a connecting ring intended to fix the teat to the flask, at the opening of the flask;

wherein the neck comprises at least one lug;

wherein the connecting ring is equipped with at least one locking element able to cooperate with one of the lugs;

each of the locking elements being able to move with respect to the connecting ring so as to be able to adopt, when the connecting ring is in position on the flask, at least two positions:

a locking position in which it cooperates with a corresponding lug of the flask so as to fix the connecting ring onto the flask;

an unlocking position in which it enables the connecting ring to be removed from the flask; and wherein the lug comprises a tongue portion on the bottom surface configured to cooperate, in the locking position, with the ramp to lock movement of the locking means with respect to the lug on the principal axis of the feeding bottle.

* * * * *